United States Patent [19]

Takemoto

[11] 4,046,126

[45] Sept. 6, 1977

[54] IGNITION APPARATUS

[75] Inventor: Takashi Takemoto, Nagaokakyo, Japan

[73] Assignee: Mitsubishi Jidosha Kogyo Kabushiki Kaisha, Tokyo, Japan

[21] Appl. No.: 637,794

[22] Filed: Dec. 4, 1975

[30] Foreign Application Priority Data

Dec. 4, 1974 Japan ..... 49-140002

[51] Int. Cl.[2] ..... F02P 5/10

[52] U.S. Cl. ..... 123/148 DS; 123/146.5 A; 123/119 LR

[58] Field of Search ..... 123/117 R, 146.5 A, 123/148 DS

[56] References Cited

U.S. PATENT DOCUMENTS

| | | | |
|---|---|---|---|
| 3,708,980 | 1/1973 | Truxell | 60/301 X |
| 3,827,237 | 8/1974 | Linder et al. | 60/276 X |
| 3,964,454 | 6/1976 | Nishimiya | 123/148 DS |

*Primary Examiner*—Carlton R. Croyle
*Assistant Examiner*—Michael Koczo, Jr.
*Attorney, Agent, or Firm*—Sughrue, Rothwell, Mion, Zinn and Macpeak

[57] ABSTRACT

An ignition apparatus is disclosed for use in a multi cylinder internal combustion engine having a first group of cylinders supplied with an enriched air-fuel mixture and a second group of cylinders supplied with a lean air-fuel mixture. A first control device controls the ignition timing of the first cylinders and a second control device controls the ignition timing of the second cylinders. The first and second control devices are adapted to operate in such a way that the ignition timing for the second cylinders is retarded relative to that for the first cylinders at medium or low load conditions of the engine, and the ignition timing for the second cylinders is advanced relative to or nearly the same as that for the first cylinders under a high load condition.

6 Claims, 5 Drawing Figures

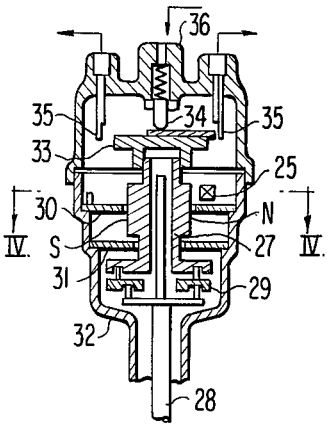
FIG.3
FIG.4
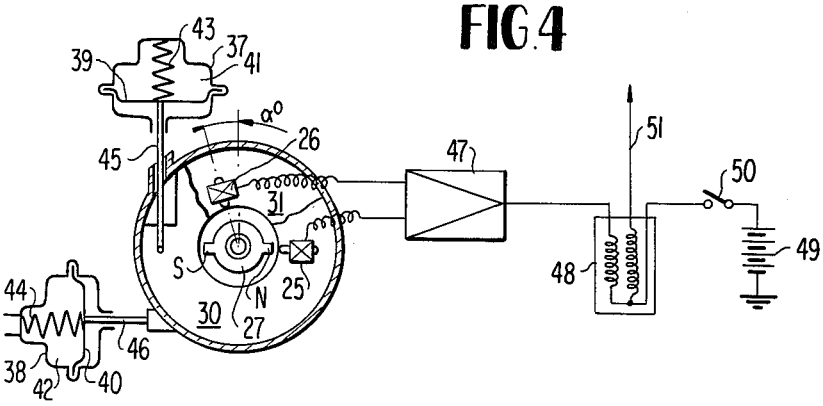
FIG.5
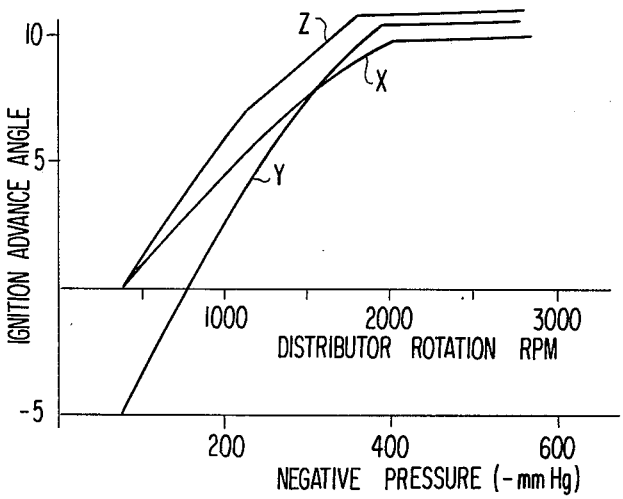

IGNITION APPARATUS

RELATED APPLICATIONS

This application is related to U.S. application Ser. No. 637,795 (corresponding to Japanese Patent Application No. 49-147239) entitled "Multi-Cylinder Internal Combustion Engine," and filed on the same date herewith.

BACKGROUND OF THE INVENTION

1. Field of the Invention

This invention relates to an apparatus for purifying exhaust gas from a multi cylinder internal combustion engine and in particular is related to an ignition system for a multi cylinder internal combustion engine.

2. Description of the Prior Art

Recently, as is well known, air pollution caused by exhaust gas from internal combustion engines has increased resulting in serious social problems. In order to reduce the pollutants in exhaust gases, various types of apparatus for purifying exhaust gases have been proposed. Each proposed apparatus has some defect such as, inadequate purifying performance, increased size and complexity of the apparatus, and the like.

Vehicle engines are generally designed so that the air-fuel ratio in each of the cylinders is kept as uniform as possible. However, in the exhaust gas, the concentration of nitrogen oxides (referred to as NOx hereinafter) is high at the air-fuel ratio at which the fuel consumption is minimized under a partial load condition. On the other hand, the concentrations of both of carbon monoxide (referred to as CO hereinafter) and hydrocarbons (referred to as HC hereinafter) are high when the throttle is opened near its extreme position because of the low air-fuel ratio providing maximum engine output. Also, since the air-fuel mixture is incompletely burned in the cylinder while the engine runs at lower speed due to reasons such as low temperature of the inside wall of the cylinder, exhaust gases containing unburned components such as CO and HC are produced. Therefore, conventional multi cylinder internal combustion engines suffer from the defect that one or more concentrations of NOx, CO and HC in the exhaust are increased under almost any running condition of the engines.

As is well known, the concentrations of the CO and HC can be reduced by the effective combustion thereof at higher temperatures with sufficient air charges, but such conditions increase the concentration of the NOx. In order to reduce the NOx concentration, the combustion temperature, and concomittantly the engine efficiency, should be lowered. One such approach includes an exhaust gas recycling system wherein the exhaust gas is partially diverted to the intake system. However, this approach has defects. Since the combustion becomes unstable without additional fuel charges, additional fuel is added simultaneously with the recirculation of the exhaust gas by the operation of enriched air-fuel mixture apparatus. However, as it is required to control the unburned gas, including the residual gas, in the combustion chamber at about a constant ratio, the apparatus for the latter method can not be simplified in structure and is expensive.

SUMMARY OF THE INVENTION

According to the present invention, the foregoing various defects are eliminated by a design which has taken in consideration the following properties in internal combustion engines.

1. NOx concentation is reduced both at lower air-fuel ratios and at higher air-fuel ratios;
2. CO and HC concentrations are increased at lower air-fuel ratios; and
3. CO and HC concentrations are reduced and the oxygen concentration is increased at higher air-fuel ratios, provided there are no misfirings.

The invention is a multi cylinder internal combustion engine, in which all of the cylinders are grouped into a first group of cylinders to be supplied with enriched air-fuel mixture and a second group of cylinders to be supplied with enriched air-fuel mixture and a second group of cylinders to be supplied with lean air-fuel mixture to thereby reduce the NOx concentration. In the exhaust system, exhaust gases from each group of cylinders are mixed, wherein CO and HC from the first group are subjected to recombustion or oxidation reaction by way of exothermic reaction mainly due to the oxygen from the second group, to thereby reduce the concentrations of the CO and HC. At the same time, ignition timings for the first and second groups are separatedly controlled to minimize the reduction in the engine output and to effectively reduce the emission of noxious gases, CO, HC and NOx.

DESCRIPTION OF THE ACCOMPANYING DRAWINGS

This invention is to be described by way of a preferred embodiment thereof referring to the accompanying drawing, wherein FIG. 1 is a vertical section of a four-cylinder internal combustion engine in accordance with the present invention.

FIG. 3 is a vertical section of an ignition apparatus for the engine of FIG. 1;

FIG. 4 is a transverse section of the embodiment of FIG. 3 taken along lines IV—IV; and FIG. 5 is a graphic representation for the illustration of ignition timing.

DETAILED DESCRIPTION OF THE PREFERRED EMBODIMENT

Figure 1:
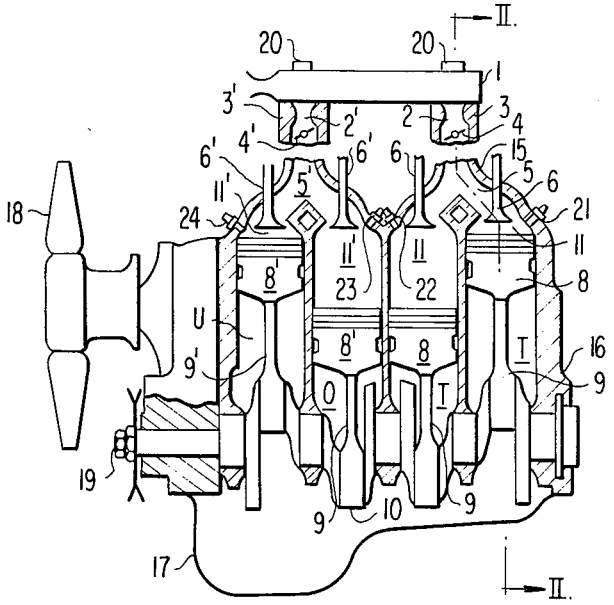
Figure 2:
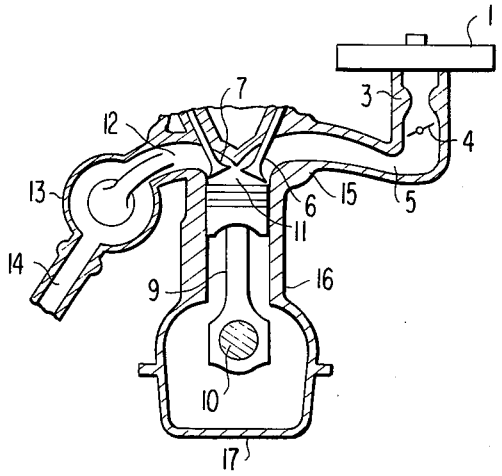
FIG. 2 is another vertical section of the engine taken along the lines II—II of FIG. 1.

Referring to FIG. 1 and FIG. 2, an air cleaner 1 is shown connected to an apparatus 2 for supplying enriched air-fuel mixture to a first group of cylinders and an apparatus 2' for supplying a lean air-fuel mixture to a second group of cylinders. Each apparatus 2, 2' may consist, for example, of a caburetor, fuel injection pump or the like. In the embodiment shown, a caburetor is employed. There are also shown venturies 3 and 3', throttle valves 4 and 4' and intake manifolds 5 and 5' for distributing the respective types of air-fuel mixture into the cylinders belonging to the corresponding groups. In the structure to be described hereinafter, those parts used with the first group of cylinders, group (a), are denoted by unprimed numbers, whereas those parts used with the second group of cylinders, group (b), are denoted by primed numbers. The cylinder group (a) and the cylinder group (b) have substantially the same construction.

The engine further includes, intake valves 6 and 6', exhaust valves 7 and 7', pistons 8 and 8' for each of the cylinder groups (a) and (b), connecting rods 9 and 9' for said pistons, crank shaft 10 connected to said connecting rods, combustion chambers 11 and 11', exhaust manifold 12, exhaust gas purifying apparatus 13, exhaust pipe 14 connected to said exhaust purifying apparatus 13, cylinder head 15, crank case 16, oil pan 17 and a fan 18 for cooling engine cooling water. The apparatus 13 may be constructed as a thermal reactor in this embodiment, provided in the exhaust system, and used for purifying the exhaust gas by means of catalysts or by way of re-combustion.

Reference numeral 20 represents retaining nuts for the above described air cleaner 1 and reference numeral 19 is a nut for mounting the above described crank shaft 10 to be crank case 16. Numerals 21, 22, 23 and 24 denote, respectively, ignition plugs provided to each of the four cylinders.

When the engine is started, air is aspirated through the air cleaner 1, mixed with fuel to form an enriched air-fuel mixture and a lean air-fuel mixture in the carburetor 2 and 2', respectively, passed through respective intake manifolds 5 and 5', and then admitted into the combustion chambers 11 and 11'. Thereafer, the air-fuel mixture goes through compression, ignition and expansion strokes as in the well known, and the remaining gases are passed via the exhaust manifold 12 to the thermal reactor 13.

By directing the outlet of the exhaust manifold 12 to the thermal reactor in a manner to cause swirling of the exhaust gas of the enriched air-fuel mixture and that of lean air-fuel mixture, the exhaust gases will mix throughly with each other after leaving said exhaust manifold 12. The CO and HC in the exhaust of the enriched air-fuel mixture is subjected to recombustion with residual oxygen contained in the exhaust of the lean air-fuel mixture to form a final exhaust gas of less CO and HC concentration which is released to the atmosphere via the exhaust pipe 14.

Additionally, since combustion occurs in the first group of cylinders at a lower air-fuel ratio and the second group of cylinders at a higher air-fuel ratio, the resulting NOx can be reduced to about one-tenth of that occurring in conventional engines wherein combustion is performed at the same air-fuel ratio for all of the cylinders.

Further, by adjusting the combined air-fuel ratio for all cylinders so as to be equal to or slightly above the theoretical ratio, CO and HC can be subjected to recombustion without providing additional air charge means to the exhaust system.

Referring to FIG. 3 and FIG. 4 a description will now be given of the ignition apparatus of this invention mounted to the multi cylinder internal combustion engine having the foregoing structure. The ignition apparatus is constructed as a wholly transistorized contactless ignition apparatus. A signal generator comprises a pair of pick-up coils 25 and 26 and a magnet 27. A driving shaft 28 is rotated by a means, such as a cam shaft (not shown) of the engine, and the rotation of said driving shaft 28 is transmitted via a governor 29 to the magnet 27 engaged over said shaft. The magnet 27 has a pair of poles N and S disposed symmetrically about the center of rotation. The pick-up coils 25 and 26 are respectively located on base plates 30 and 31 which are mounted within a distributor housing 32 so as to be individually rotatable in a coaxial relation to said driving shaft 28 in a manner explained hereafter. The magnet 27 and a distributor rotor 33 are secured integrally and are rotatable coaxially. The distributor rotor 33 distributes electric energy in a conventional manner by successively electrically connecting an electrode 34 to four electrodes 35 arranged on a distributor cap 36. The base plates 30 and 31 are rotated by different negative pressure diaphragms 37 and 38 for controlling the ignition timing of the plugs 21–24. That is, negative pressure for advancing ignition timing is applied to each of the chambers 41 and 42 sealed by each of the diaphragms 39 and 40 of the negative pressure diaphragms 37 and 38. The device 37 is adjusted so that the diaphragm 39 moves rod 45 against the force of a coil spring 43 to rotate clockwise the base plate 30 on which the pick-up coil 25 is attached, thereby causing a change in the induction timing of the electromotive force in the pick-up coil 25 relative to the rotation of the magnet 27 to obtain a negative pressure-ignition timing characteristic represented by the curve X in FIG. 5. On the other hand, the device 38 is adjusted so that the diaphragm 40 moves rod 46 against the force of the coil spring 44 to rotate clockwise the base plate 31 on which the pick-up coil 26 is attached, thereby causing a change in the induction timing of the electromotive force in the pick-up coil 26 relative to the rotation of the magnet 27 to obtain a negative pressure-ignition timing characteristic respresented by the curve Y in FIG. 5.

Since the pick-up coil 26 is mounted with an angle of $90° + \alpha°$ relative to the pick-up coil 25, said $\alpha°$ being 2.5° in one specific embodiment, the ignition timing for the pick-up coil 26 is $-5°$ as expressed in the crank angle relative to the ignition timing of 0° for said pick-up coil 25 during idling condition. Generally, the ignition timing is advanced as the load for the engine increases above the idling condition. In the present invention, by adjusting the resilient forces of the coil springs 43 and 44 or the areas of the diaphragms 39 and 40 subjected to the negative pressure created in the engine as the rpm increases, the ignition timing for the pick-up coil 26 advances at a greater rate than that for the pick-up coil 25. This is illustrated by curves X and Y. As shown curve X lies above curve Y during medium and low engine load conditions, but curve Y lies above curve X during high engine load conditions.

In FIG. 4, there is also illustrated a circuit comprising an igniter amplifier 47 preferably of the transistorized type, an ignition coil 48, a battery 49 and a key switch 50. Secondary winding 51 of the ignition coil 48 is connected by way of the electrode 34 to the distributor rotor 33 to thereby distribute electrical energy generated in said ignition coil 48 through the four electrodes 35 to each of the ignition plugs 21, 22, 23 and 24 shown in FIG. 1. The electric connections are made in such a manner that the ignition timings of the ignition plugs 21 and 22, provided for the first cylinder group (a) supplied with the enriched air-fuel mixture, are controlled by the pick-up coil 25, and the ignition timings of the ignition plugs 23 and 24, provided for the second cylinder group (b) supplied with lean air-fuel mixture, are controlled by the pick-up coil 26. The curve Z shown in FIG. 5 represents a centrifugal ignition timing advancing characteristic produced by the rotational movement of the magnet 27 relative to the drive shaft 28 caused by the action of the governor 29 resulting from the rotation of the distributor.

In the ignition apparatus having the foregoing construction, the ignition timings for the first cylinder group (a) are controlled by the governor 29 and by the negative pressure diaphragm 39 for advancing ignition timing, so that the ignition timings for the ignition plugs 21 and 22 provided for said cylinder group (a) are represented as the sum of the values given by the curve X and the curve Z in various load regions as shown in FIG. 5.

Similarly, the ignition timings for the second cylinder group (b) are controlled by the governor 29 and by the negative pressure diaphragm 38 for advancing the ignition timing, so that the ignition plugs 23 and 24 provided for said cylinder group (b) are represented as the sum of the values given by the curve Y and the curve Z in various load regions as shown in FIG. 5.

Accordingly, the ignition timing for the second cylinder group (b) is behind that of the ignition timing for the first cylinder group (a) during medium or low engine load conditions. However, at high engine load conditions, the above ignition timings are reversed for the two cylinder groups.

Due to the basic nature of combustion, more NOx is produced from the second cylinder group (b) (receiving the lean air-fuel mixture) than from the first cylinder group (a) (receiving the enriched air-fuel mixture), when the ignition timings for them are the same. Therefore the total emission of NOx can further be reduced significantly by decreasing the NOx emission from said second cylinder group (b). By retarding the ignition timing for the second cylinder group (b) as much as possible, relative to the timing of group (a), during medium or low engine load conditions, the maximum temperature in the combustion chambers 11' is lowered and consequently the amounts of NOx exhausted from said cylinder group (b) are thereby reduced. Additionally, since the unburned fuel in cylinders (b) will exothermically oxidize due to the excess $O_2$ in the exhaust of cylinders (b), the exhaust gases will have an increased temperature which improves the efficiency of the exhaust gas purifying apparatus 13 thereby contributing to the burning of HC and CO from the exhaust of cylinders (a). In addition, reduction in engine outputs and in specific fuel consumption are minimized by advancing as much as possible the ignition timing for the other cylinder group (a).

During high engine load condition, by controlling the ignition timing of the cylinder group (b) nearly identical to or in advance of the ignition timing of the cylinder group (a), sufficient engine outputs can be produced also in the cylinder group (b) thereby enabling the improvements for the total engine outputs and fuel consumption.

During the high engine load condition further improvement in the outputs can of course be attained by somewhat reducing the air-fuel ratio. While in the embodiment described above the same centrifugal ignition timing is given to both of the pick-up coils 25 and 26, more effective exhaust purification and further improvements in outputs may be attained by providing different governors having different ignition timing characteristics to each of the pick-up coils 25 and 26 respectively so as to utilize at most of the properties of enriched and lean air-fuel mixtures relative to the revolutional numbers of an engine. Although the description is made to the above embodiment with the transistorized contactless type ignition apparatus, it will easily be understood that quite the same effects and advantages as in the above embodiment can also be attained with a contact breaker type apparatus conventionally used so far.

What is claimed is:

1. Ignition apparatus for use in a multi cylinder internal combustion engine having a first group of cylinders, means for supplying at least one cylinder of said first group of cylinders with an enriched air-fuel mixture relative to stoichiometric air-fuel ratio, a second group of cylinders, and means for supplying at least one cylinder of said second group of cylinders with a lean air-fuel mixture relative to stoichiometric air-fuel ratio, said ignition apparatus comprising ignition timing control means responsive to the rpm of the said engine for retarding the ignition timing of said second group of cylinders relative to the ignition timing of said first group of cylinders when the engine is operated at low and medium loads and for advancing the ignition timing of said second group of cylinders relative to the ignition timing of said first group of cylinders when said engine is operated at heavy loads.

2. The ignition apparatus of claim 1 wherein said ignition timing control means comprises, a. distributor means having a common terminal and a plurality of other terminals, one for each cylinder, said distributor including a rotor for successively connecting said other terminals to said common terminal, said other terminals being connected to respective plus for the respective cylinders of said engine, b. magnetic poles placed on said rotor c. first and second means for sensing when the said magnet poles pass adjacent said first and second sensing means, respectfully, d. circuit means connected to said first and second sensing means and to said common terminal for developing a charge, when either sensing means senses said poles, which is sufficient to fire the plug connected at that instance to said common terminal, said first sensing means being positioned to cause firing of the plugs for said first group of cylinders and said second sensing means being positioned to cause firing of the plugs for said second group of cylinders, e. first adjusting means responsive to the rpm of the engine for altering the position of said first sensing means to advance the firing of the plugs associated with said first group of cylinders as the rpm increase, and f. second adjusting means responsive to the rpm of the engine for altering the position of said second sensing means to advance the firing of the plugs associated with said second group of cylinders as the rpm increase, said second means being adapted to cause a greater adjustment than said first means for a given increase in rpm.

3. The ignition system of claim 2 wherein sid first sensing means is an inductive magnetic field sensor and is positioned on a first platform that is rotatably adjustable to adjust the circumferential position of said first sensor relative to the circumference of said rotor, and wherein said second sensing means is an inductive magnetic field sensor and is positioned on a second platform that is rotatably adjustable to adjust the circumferential position of said second sensor relative to the circumference of said rotor.

4. The ignition system of claim 3 wherein the magnetic poles consist of a north and a south pole positioned at opposite circumferential points of said rotor.

5. The ignition system of claim 3 wherein said first and second adjusting means each comprises a negative pressure sensing device, having a diaphragm and a driving means connected to the respective first and second platform, for rotating said platform slightly in response to a change in the negative pressure sensed by said diaphragm.

6. The ignition system of claim 2 further comprising a shaft rotatably synchronously connected to a cam shaft of said engine, and a governor connecting the rotational motion of said shaft to the said rotor.

* * * * *